US008840489B2

(12) United States Patent
Del Rosario et al.

(10) Patent No.: US 8,840,489 B2
(45) Date of Patent: Sep. 23, 2014

(54) PUTTER FACE INSERT

(75) Inventors: Justin Del Rosario, Chino Hills, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 414 days.

(21) Appl. No.: 13/312,166

(22) Filed: Dec. 6, 2011

(65) Prior Publication Data

US 2012/0149492 A1 Jun. 14, 2012

Related U.S. Application Data

(60) Provisional application No. 61/422,078, filed on Dec. 10, 2010.

(51) Int. Cl.
*A63B 53/04* (2006.01)

(52) U.S. Cl.
CPC ..... *A63B 53/0487* (2013.01); *A63B 2053/0425* (2013.01)
USPC ..... 473/329; 473/340; 473/342

(58) Field of Classification Search
USPC ..... 473/324–350
See application file for complete search history.

(56) References Cited

U.S. PATENT DOCUMENTS

| | | | | | |
|---|---|---|---|---|---|
| 5,083,778 | A * | 1/1992 | Douglass | 473/329 |
| 5,464,212 | A * | 11/1995 | Cook | 473/329 |
| 5,709,616 | A | 1/1998 | Rife | |
| 5,766,093 | A * | 6/1998 | Rohrer | 473/329 |
| 5,921,871 | A * | 7/1999 | Fisher | 473/329 |
| 6,001,030 | A * | 12/1999 | Delaney | 473/329 |
| D429,302 | S | 8/2000 | Antonious | |
| 6,302,807 | B1 * | 10/2001 | Rohrer | 473/329 |
| 6,431,997 | B1 * | 8/2002 | Rohrer | 473/324 |
| 6,699,140 | B1 * | 3/2004 | Sun | 473/252 |
| 6,743,117 | B2 * | 6/2004 | Gilbert | 473/332 |
| 7,192,365 | B2 * | 3/2007 | Souza et al. | 473/329 |
| 7,273,420 | B2 * | 9/2007 | Wright | 473/329 |
| 7,309,296 | B2 * | 12/2007 | Souza et al. | 473/329 |
| 7,713,139 | B1 * | 5/2010 | Stites et al. | 473/329 |
| 7,862,449 | B2 * | 1/2011 | Stites et al. | 473/329 |

* cited by examiner

*Primary Examiner* — Alvin Hunter
(74) *Attorney, Agent, or Firm* — Rebecca Hanovice; Michael A. Catania; Sonia Lari

(57) ABSTRACT

The putter face insert of the present invention reduces or eliminates backspin, and in some circumstances even imparts topspin, of a golf ball after impact with the putter face by including a contact surface with uniform thickness and at least one backing having non-uniform thickness. Generally, reducing initial backspin improves distance control and directional consistency of a golf ball when putting.

11 Claims, 1 Drawing Sheet

PUTTER FACE INSERT

CROSS REFERENCES TO RELATED APPLICATIONS

The present application claims priority to U.S. Provisional Patent Application No. 61/422,078, filed on Dec. 10, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a putter face insert that reduces or eliminates backspin, and in some circumstances imparts topspin, of a golf ball after impact with the putter face.

2. Description of the Related Art

Prior art putters and putters currently sold in the marketplace tend to impart unwanted backspin on a golf ball as it leaves the putter face, primarily due to the loft of these putters. It is understood that too much initial backspin on the ball when leaving the putter face reduces putting accuracy. As such, it is desirable to reduce or eliminate backspin, or even impart topspin, when putting in order to increase distance and directional control over the golf ball.

Although the prior art discloses various types of putter inserts, most putters do not use face technology intended to reduce backspin. While some golf club manufacturers use groove technology in an attempt to reduce backspin, the current technology on the market and the prior art has failed to provide a putter insert that effectively reduces or eliminates backspin.

BRIEF SUMMARY OF THE INVENTION

One aspect of the present invention is a putter face insert comprising a contact surface having uniform thickness composed of a single piece of a hard metal material, a first backing having non-uniform thickness composed of a soft polymer material, and a second backing having non-uniform thickness composed of a hard metal material, wherein the first backing is sandwiched between the contact surface and the second backing, and wherein the non-uniform thickness of the second backing complements the non-uniform thickness of the first backing such that alignment of the first and second backings forms a cube or a rectangular prism.

Another aspect of the present invention is a putter head comprising a front recess and a face insert comprising a contact surface and a backing, wherein the contact surface has uniform thickness, wherein the backing has non-uniform thickness, and wherein the face insert is disposed within the front recess. The contact surface is composed of a hard material such as a metal alloy, which includes an iron alloy. The backing is composed of a soft material, such as a polymer, and more specifically polyurethane. The backing may have a gradient thickness, and the face insert as a whole may have a gradient hardness along a vertical direction of the contact surface, and more specifically may have a greater hardness at a top region than at a bottom region. The face insert of the present invention may also impart topspin to a golf ball after impact.

Yet another aspect of the present invention is a putter face insert comprising a contact surface having uniform thickness and a backing having non-uniform thickness, wherein the contact surface is composed of a hard metal material, and wherein the backing is composed of a soft polymer material. The backing may be adhered to the contact surface, and may have a thin portion proximate a top region of the contact surface and a thick portion proximate a bottom region of the contact surface. The putter face insert may further have a gradient hardness along a vertical direction of the contact surface, and may further have a greater hardness at a top region than at a bottom region.

The putter face insert of each aspect of the invention disclosed herein may also impart topspin to a golf ball after impact.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a putter face insert that reduces or eliminates backspin, or even imparts topspin, of a golf ball after impact. The novel face insert includes one or more gradient thickness backings that create a gradient hardness along a vertical direction of the contact surface for the purpose of affecting backspin.

Figure 1:
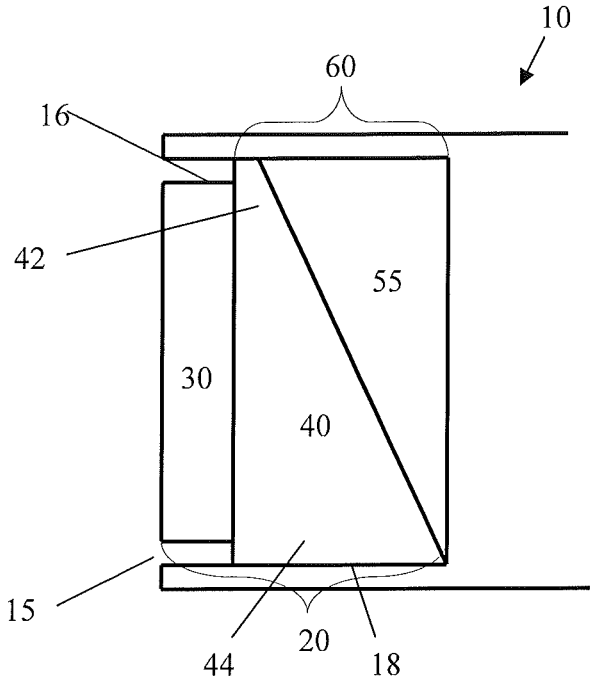
FIG. 1 is a side cross-sectional view of a putter head of the present invention.

A preferred embodiment of the present invention is shown in FIG. 1. A putter 10 has a front recess 15 to house a putter face insert 20 comprising at least two pieces: a uniform thickness contact surface 30 comprising a hard material; and a first backing 40 comprising a softer material. The hard material preferably comprises a metal material, such as iron alloy, titanium, titanium alloy, tungsten, or other such metals and metal alloys. In other embodiments, the hard material may be a hard composite material. The uniform thickness contact surface 30 is designed to connect with a golf ball during putting.

The first backing 40 of the putter face insert 20 does not have uniform thickness. Instead, the backing 40 has a thin portion 42 proximate the top 16 of the putting face and a thicker portion 44 proximate the sole 18, following a gradient. The softer material of the backing 40 preferably comprises or consists of a polymer, such as polyurethane. The backing 40 of the present invention provides softer support to the contact surface 30 near the sole 18 of the putter face insert 20 and firmer support near the top 16 of the putter face insert 20. Thus, the contact surface 30 has a gradient hardness in the vertical direction along the putter face insert 20. The greater hardness at the top 16 reduces backspin of a golf ball after impact with the contact surface 30.

Figure 2:
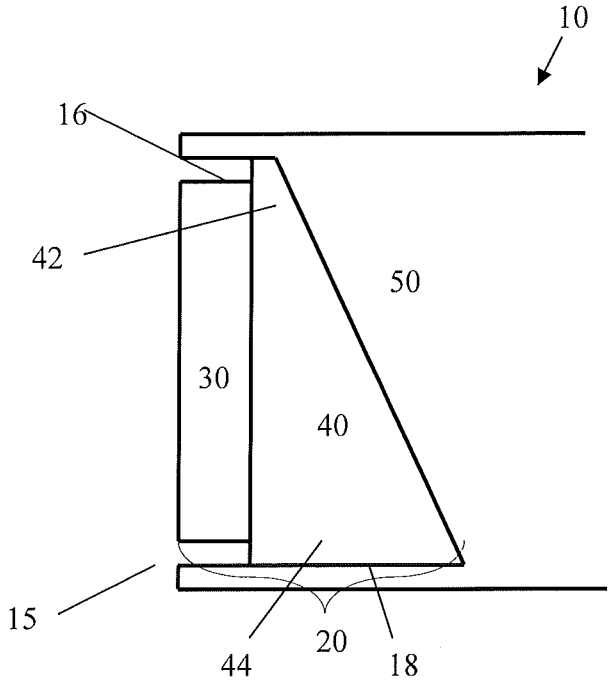
FIG. 2 is a side cross-sectional view of another putter head of the present invention.

In certain embodiments of the present invention, another hard material 50, 55 is located behind the first backing 40. This hard material 50 may be part of the putter head itself, as shown in FIG. 2, but most preferably it is another piece of the face insert 20, as shown in FIG. 1, e.g., a second backing 55. A face insert having a second backing 55 made of hard material is easier to manufacture and to install in the recess 15 of a putter head 10. This second backing 55 supports the first backing 40 and follows the gradient of the first backing 40, such that aligning the first and second backings 40, 55 creates a cube or a rectangular prism 60, as shown in cross-section in FIG. 2.

The putter face insert 20 of the present invention may be retained within the front recess 15 of the putter head 10 by any means known in the art, including by an adhesive or one or more mechanical fasteners.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A putter head comprising:

a front recess; and a face insert comprising a contact surface, a first triangular backing, and a second triangular backing;

wherein the contact surface has uniform thickness, wherein the first triangular backing is disposed directly behind the contact surface and has a thin portion proximate a top region of the contact surface and a thick portion proximate a bottom region of the contact surface, wherein the second triangular backing is disposed directly behind the first triangular backing, wherein the face insert has a gradient hardness along a vertical direction of the contact surface, and wherein the face insert is disposed within the front recess.

2. The putter head of claim 1, wherein the second triangular backing is composed of a hard material.

3. The putter head of claim 1, wherein the contact surface is composed of a hard material.

4. The putter head of claim 1, wherein the contact surface is composed of a metal alloy.

5. The putter head of claim 4, wherein the metal alloy is an iron alloy.

6. The putter head of claim 1, wherein the first backing is composed of a soft material.

7. The putter head of claim 1, wherein the first backing is composed of a polymer.

8. The putter head of claim 7, wherein the first backing is composed of polyurethane.

9. The putter head of claim 1, wherein the first backing has a gradient thickness.

10. The putter head of claim 1, wherein the face insert imparts topspin to a golf ball after impact.

11. A putter head comprising:

a front recess; and a face insert comprising a contact surface, a first triangular backing, and a second triangular backing;

wherein the contact surface has uniform thickness, wherein the first triangular backing is disposed directly behind the contact surface and has a thin portion proximate a top region of the contact surface and a thick portion proximate a bottom region of the contact surface, wherein the second triangular backing is disposed directly behind the first triangular backing, wherein the face insert has greater hardness at a top region than at a bottom region, and wherein the face insert is disposed within the front recess.

* * * * *